United States Patent [19]

Pflederer

[11] Patent Number: 4,604,675

[45] Date of Patent: Aug. 5, 1986

[54] FUEL INJECTION SOLENOID DRIVER CIRCUIT

[75] Inventor: Mark R. Pflederer, Tremont, Ill.

[73] Assignee: Caterpillar Tractor Co., Peoria, Ill.

[21] Appl. No.: 755,385

[22] Filed: Jul. 16, 1985

[51] Int. Cl.[4] ..... H01H 47/32; F02D 1/00

[52] U.S. Cl. ..... 361/155; 123/490

[58] Field of Search ..... 361/152, 154, 155, 156; 123/490

[56] References Cited

U.S. PATENT DOCUMENTS 4,479,161 10/1984 Henrich et al. ..... 123/490 X

*Primary Examiner*—Michael L. Gellner

*Attorney, Agent, or Firm*—Terry D. Morgan

[57] ABSTRACT

A fuel injection solenoid driver circuit controllably connects and disconnects a solenoid coil to and from a storage capacitor to effect operation of the coil. Precise control of the timing and duration of coil is necessary to ensure that a proper quantity of fuel is delivered to each cylinder of an internal combustion engine. A means monitors the voltage level of the storage capacitor and periodically delivers a high voltage inductive spike to the capacitor to maintain the capacitor voltage level within prescribed limitations. Further, a means aids in charging the capacitor by discharging the solenoid coil to the capacitor in response to the coil and capacitor being disconnected. Use of the energy stored in the coil to recharge the capacitor increases the power efficiency of the circuit and also results in a fast decay of the solenoid voltage. The fast decay time minimizes variations in solenoid operation timing and duration and precisely controls the quantity of fuel delivered.

6 Claims, 5 Drawing Figures

MULTI-PLEXER
200
MONOSTABLE MULTI-VIBRATOR
INJ
+5V
REF.
+12V

FUEL INJECTION SOLENOID DRIVER CIRCUIT

TECHNICAL FIELD

This invention relates generally to a solenoid driver circuit for a fuel injection system of an internal combustion engine, and more particularly, to an energy saving apparatus which recovers the power normally dissipated by the current flyback path in a conventional solenoid driver.

BACKGROUND ART

In the field of electronically controlled fuel injection systems, it is imperative that electromagnetic solenoids be provided which are capable of high speed operation and have consistently reproducible stroke characteristics. The necessity of high speed operation requires little explanation when one considers that an engine operating at 2000 rpm must have fuel injected into each cylinder of a multicylinder engine at 10 millisecond intervals and the entire injection pulse occurs over only a 1 millisecond period. Slow acting solenoids result in erroneous quantities of fuel being delivered to each cylinder at an inappropriate timing advance which can adversely affect the performance of the engine.

High speed solenoid operation is obviously an absolute necessity; however, the need for consistently reproducible stroke characteristics is a less obvious but equally important requirement. A reproducible solenoid stroke provides the precise control needed to obtain maximum fuel efficiency, power output, and engine life and has also been shown to have beneficial effects on the quantity and type of exhaust emissions. These benefits extend from the fact that the quantity of fuel injected into a cylinder is typically controlled by the duration of time for which the solenoid is maintained in an open configuration. Thus, a given voltage applied to the solenoid for a given duration of time should result in the solenoid being operated to an open configuration for a substantially standard duration of time and thereby deliver a standard preselected quantity of fuel. Once the relationship between voltage, time, and quantity of fuel has been established, it should remain constant throughout the useful life of the apparatus. Therefore, a fuel injection solenoid control can provide advantageous control of engine operation over the entire range of engine speed by delivering a regulated voltage for a variable duration of time.

Further, in the operation of a fuel injection system on a multicylinder engine, a fuel injection solenoid is provided for each engine cylinder and must be energized and de-energized for each compression stroke of the corresponding engine cylinder. Typically, the energy stored in the solenoid is transformed into heat by a diode and resistor combination placed in the flyback current path of each solenoid. The magnitude of the energy disposed of in this manner is significant and directly results in an increase to the cost of the system. The heat generated by the discharging solenoids exacerbates the problem of heat dissipation in an already thermally hostile environment. Additional means must be provided to remove the excess heat to maintain the reliability of the electronic hardware. Increased heat dissipation capability is a directly measurable cost.

Additionally, significantly greater power generating capability is necessary than would be if a portion of the stored energy could be recovered.

The present invention is directed to overcoming one or more of the problems as set forth above.

DISCLOSURE OF THE INVENTION

In accordance with one aspect of the present invention, a fuel injection solenoid driver circuit has a first switching means which controllably connects and disconnects a solenoid coil to and from a storage capacitor when a control signal is received and a second switching means which controllably connects and disconnects the solenoid coil to and from system ground when a control signal is received. A means delivers a first control signal to the first and second switching means and enables the first and second switching means for a first preselected duration of time to initiate current flow in the solenoid coil. A third means senses the magnitude of the current in the solenoid coil and delivers a second control signal to the first switching means to alternately connect and disconnect the solenoid coil to and from the storage capacitor when the magnitude of the current respectively falls below and rises above a first and second preselected level. A fourth means senses the magnitude of the current in the solenoid coil and delivers a third control signal to the first switching means to alternately connect and disconnect the solenoid coil to and from the storage capacitor when the magnitude of the current respectively falls below and rises above a third and fourth preselected level where the third and fourth preselected levels are less than both of the first and second preselected levels. A fifth means prevents delivery of the third control signal for a second preselected duration of time after the first control signal is received. A sixth means prevents delivery of the first control signal for a third preselected duration of time after termination of the second preselected duration of time. A means discharges the solenoid coil to the storage capacitor when the solenoid coil is disconnected from both the storage capacitor and system ground.

BEST MODE FOR CARRYING OUT THE INVENTION

Figure 1:
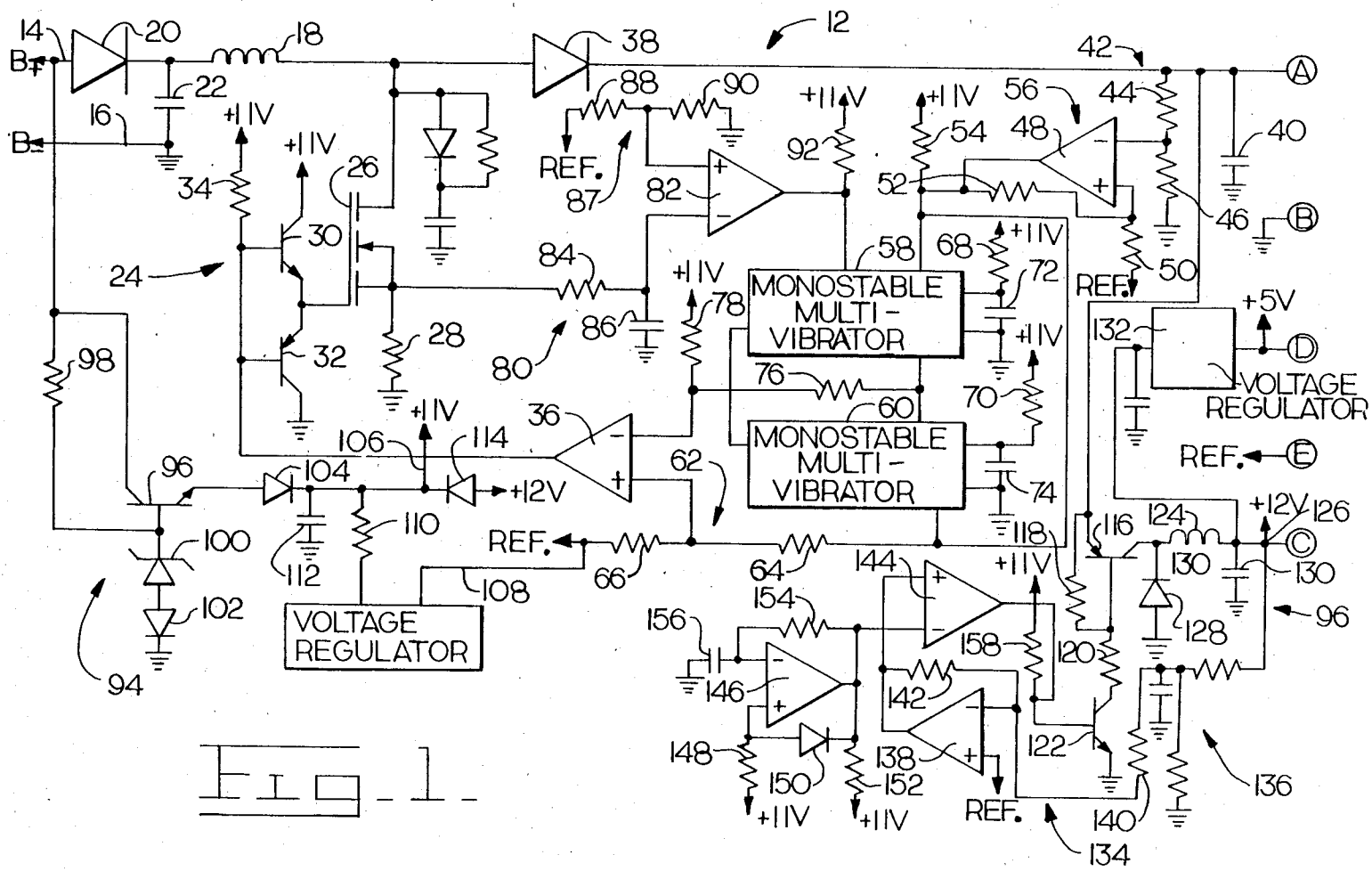
FIG. 1 illustrates an electrical schematic of an embodiment of a step up voltage supply.

Referring now to the drawings, wherein a preferred embodiment of the present apparatus 10 is shown, FIG. 1 illustrates an electrical schematic of a step up voltage supply 12. First and second lead lines 14,16 are shown connected to the positive (B+) and negative (B−) terminals of a voltage source which can be, for example, a 12 volt lead acid battery. The positive lead line 14 is connected to an inductor 18 through a diode 20. A noise suppressing capacitor 22 is connected between the anode of the diode 20 and the negative lead line 16. The inductor 18 is also connected through a low impedence path to ground via a switching means 24. The switching means 24 includes a field effect transistor 26 with a drain connected to the inductor 18 and a source connected through a current sensing resistor 28 to system ground. A gate of the transistor 26 is connected to the intersection of a pair of emitters of a first npn type transistor 30 and a second pnp type transistor 32. The collectors of the first and second transistors are respectively connected to +11V and system ground while both bases are connected through a pull up resistor 34 to +11V and to the output of an open collector comparator 36.

The inductor 18 is also connected through a diode 38 to a storage capacitor 40 and a voltage divider network 42 which consists of a pair of resistors 44,46 serially connected to system ground. The intersection of the resistors 44,46 is connected to an inverting input of an open collector comparator 48. A noninverting input of the comparator 48 is connected through resistor 50 to a reference voltage and to the output of the comparator 48 via resistor 52. A resistor 54 interconnects the output of the comparator 48 to +11V. The comparator 48 and attendant resistors 44, 46, 50, 52, 54 comprise a means 56 which monitors the magnitude of the voltage of the storage capacitor 40 and delivers a control signal to the switching means 24 in response to the voltage of the storage capacitor being greater than a preselected magnitude. Selection of the ohmic value of the resistors 44,46 of the voltage divider network 42 and the reference voltage determines the magnitude of the voltage of the storage capacitor at which the means 56 delivers the control signal. Further, resistors 50,52 define the magnitude of the hysteresis experienced by the means 56. For example, the storage capacitor voltage rises to a preselected magnitude such that the voltage applied to the inverting input is greater than the voltage applied to the noninverting input and the control signal is subsequently delivered. Feedback provided by the resistors 50, 52 ensures that for the control signal to be discontinued, the voltage must fall to a preselected magnitude less than the first preselected magnitude. The difference between the preselected magnitudes is the hysteresis which is of a sufficiently small magnitude to minimize voltage ripple on the storage capacitor but not so small as to cause oscillation in the comparator 48. Preferably, the respective first and second preselected voltages are selected to 90V and 88V.

The output of the comparator 48 is connected to clear inputs of a first and second monostable multivibrator 58,60 and to a reference voltage through a voltage divider network 62. The divider network 62 includes two series resistors 64, 66, the intersection of which is connected to a noninverting input of the comparator 36. The multivibrators 58, 60 are standard electronic components which are commercially available from a variety of manufacturers and are operable to deliver a digital pulse for a preselected duration of time. The magnitude of the time durations are respectively controlled by inputs from resistors 68, 70 and capacitors 72, 74 serially connected between +11V and system ground. The values of the resistor and capacitor pairs 68,72;70,74 are selected such that the time duration of the pulse of the second multivibrator 60 is significantly longer than the duration of the pulse delivered by the first multivibrator 58. The second multivibrator 60 acts as a reset for the first multivibrator 58 in the event that battery voltage is insufficient to generate a current in the resistor 28 to trigger the first multivibrator 58. The first and second multivibrators 58, 60 are interconnected to provide the trigger signal through an output of the multivibrator 60 connected to a control input of the first multivibrator 58. The output of the first multivibrator 58 is connected through a resistor 76 to an inverting input of the comparator 36 and to +11V through a pull up resistor 78. The control input of the second multivibrator 60 is connected to the output of the comparator 36.

A means 80 monitors the magnitude of the current flowing through the low impedence path formed by the transistor 26 and the current sensing resistor 28 and delivers a control signal to the switching means 24 for a preselected duration of time in response to the magnitude of the current being greater than a preselected level. The means 80 includes an open collector comparator 82 which has an inverting input connected through a resistor 84 to the junction of the transistor 26 and the resistor 28. A noise suppressing capacitor 86 connects the inverting input of the comparator 82 to system ground. The noninverting input of the comparator 82 is connected to a voltage divider network 87 formed by series resistors 88,90 connected between reference voltage and system ground. The output of the comparator 82 is connected to +11V through a pull up resistor 92 and to a control input of the first multivibrator 58.

Figure 3:
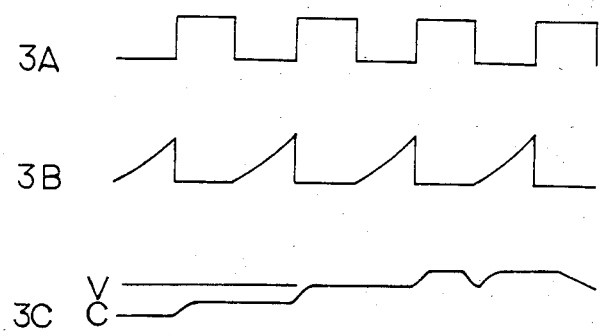
FIG. 3 illustrates a graphical representation of a group of electrical waveforms associated with the electrical schematic of the step up voltage supply circuit.

Operation of the step up voltage supply 12 can best be illustrated in conjunction with the schematic waveforms of FIG. 3. The voltage applied to the gate of the transistor 26 is shown in FIG. 3*a* where the "high" voltage indicates that the transistor 30 has connected +11V to the gate of the transistor 26. The transistor 26 is biased "on" and conducts current from the battery through the inductor 18, transistor 26, and current sensing resistor 28 during the "high" periods of the waveform of FIG. 3*a*. The waveform of FIG. 3*b* graphically represents the current flowing through the current sensing resistor 28. When the transistor 26 is biased "on", current begins to flow through the resistor 28 increasing exponentially at a rate related to the resistance and inductance in the current path. The current continues to increase until the voltage drop across the resistor 28 becomes of a magnitude greater than the drop present on the voltage divider network 86, the comparator 82 is biased "off" which connects the pull up resistor 92 to system ground and delivers a trailing edge pulse to the control input of the multivibrator 58. The output of the multivibrator 58 goes "high" for a preselected duration of time and increases the voltage presented to the inverting input of the comparator 36 to +11V. The comparator 36 is biased "off" which, in turn, biases transistor 32 "on", transistor 26 "off", and terminates the current flowing through the low impedence path.

Isolation of the charged inductor 18 from system ground generates an inductive spike of significant proportion which induces the diode 38 to conduct current to the storage capacitor 40 and charge the capacitor 40 to a voltage greater than the voltage of the battery. After the multivibrator has timed out, the voltage presented to the inverting input of the comparator 36 will be reduced by a voltage divider network formed from resistors 76, 78. The comparator 36 returns to an "on" condition at which time the entire process is repeated. Each cycle increases the storage capacitor voltage by a relatively small magnitude; therefore, a multiplicity of cycles is required to initially charge the storage capacitor 40 from 0V to 90V. The waveform illustrated in FIG. 3*c* shows a small number of transistions occurring; however, one skilled in the art of power supply design will recognize that many cycles are required, but to simplify the description, relatively few cycles have been shown.

The charging cycles continue until such time as the voltage level of the storage capacitor 40 reaches such a level that the divider network 42 applies a voltage to the inverting input of the comparator 48 of a greater magnitude than the voltage applied to the noninverting input of the comparator 48. The comparator 48 is subsequently biased "off" and connects the clear input of the first multivibrator 58 to system ground. The output of the multivibrator 58 is thus disabled which ultimately prevents the current monitoring means 80 from controlling the bias of the transistor 26. The multivibrator 58 functions such that the output remains "low" while the clear input is also "low", irrespective of the condition of the input from the comparator 82. However, the output of the comparator 48 also controls the magnitude of the voltage applied to the noninverting input of the comparator 36. In this manner, control of the switching means 24 is transferred from the current monitoring means 24 to the voltage monitoring means 56. When the comparator 48 is biased "on", the resistors 66, 64 form a voltage divider network which reduces the voltage applied to the noninverting input of the comparator 36 to a magnitude less than the magnitude of the voltage applied by the voltage divider network 76, 78. The comparator 36 remains biased "off" while the storage capacitor voltage remains above the lower switching voltage of the comparator 48. Consequently, during the same period of time, the transistor 26 remains biased "off" and current does not flow through the current sensing resistor 28.

At some future time, the storage capacitor 40 will ultimately be subjected to a load and begin to discharge until the voltage level reaches the lower switching level of the comparator 48. The comparator 48 is biased "on" and returns the clear input of the multivibrator 58 to a "high" condition which enables the multivibrator to react to the current monitoring means 80. Additionally, the voltage applied to the noninverting input of the comparator 36 is returned to the reference voltage to bias the comparator 36 "on", the transistor 26 "on", and initiate current flow in the current sensing resistor 28. The current monitoring means 80 reacts to the current level to bias the transistor 26 "off" for a preselected duration of time which creates the inductive spike and charges the storage capacitor 40. The process is repeated until the storage capacitor voltage is returned to the upper switching level of the comparator 48.

Two separate alternate means 94, 96 are provided to supply regulated voltage to the electronic circuitry of the instant apparatus 10. Alternate means 94, 96 are required because during the initial start-up phase of the apparatus 10, the storage capacitor 40 which normally supplies power to the circuitry has not been charged to a sufficient level to ensure reliable performance. Therefore, the first alternate means 94 is connected directly to the battery through the lead line 14 and provides the initial power to the electronic circuitry to charge the storage capacitor 40. The second alternate means 96 is connected directly to the storage capacitor 40 and is necessary because when an attempt is made to start an internal combustion engine, the load experienced by the storage battery is severe and can result in the battery voltage being substantially reduced. The voltage drop experienced during engine starting is often of a sufficient magnitude such that the electronic circuitry is unable to draw adequate power to operate accurately and reliably. Thus, both the first and second alternate means 94, 96 are required to ensure a reliable power supply under all operating conditions.

The first alternate means 94 includes an npn type transistor 96 which has a resistor 98 connected in parallel with the collector and base to positive battery supply. The base of the transistor 96 is also connected to system ground through a serially connected zener diode 100 and a diode 102. A diode 104 is connected between the emitter of the transistor 96 and a +11V supply tap 106. The reference voltage level is supplied by a voltage regulator 108 connected to the tap 106 via a resistor 110. A noise suppressing capacitor 112 is connected between the tap 106 and system ground.

The second alternate means 96 also supplies power to the +11V tap 106 via a diode 114. The second alternate means 96 operates as a step down voltage supply and includes a pnp type switching transistor 116 which has a resistor 118 connected in parallel with the emitter and base of the transistor 116 to the storage capacitor 40. The base of the transistor 116 is connected to system ground through a resistor 120 and a transistor 122. The collector of the transistor 116 is connected to the diode 114 via an inductor 124 and a 12V tap 126. A flyback current path is provided for the inductor 124 by a diode 128 and a capacitor 130 connected between system ground and alternate leads of the inductor 124. A voltage regulator 132 is also connected to the inductor 124 and supplies +5V to the electronic circuitry.

A means 134 monitors the voltage level of the +12V tap 126 and controllably connects and disconnects the storage capacitor 40 to the +12V tap 126 in response to the magnitude of the voltage being respectively greater or less than a preselected magnitude. The means 134 includes a voltage divider network 136 connected between the +12V tap 126 and system ground. A comparator 138 has an inverting input connected to the voltage divider network 136 via a resistor 140 and a feedback resistor 142 connected between the output and the inverting input. The noninverting input of the comparator 138 is connected to the reference voltage. The comparator 138 is connected as an error amplifying circuit which provides an analog voltage signal with a magnitude related to the difference between the reference voltage and the voltage present on the divider network 136. A comparator 144 has a noninverting input connected to the output of the comparator 138 and an inverting input connected to an output of a comparator 146. The comparator 146 is connected to operate as an asynchronous oscillator generating a triangular waveform between a first and second preselected voltage. The comparator 146 has a noninverting input connected to +11V through a resistor 148 and to the output of the comparator 146 via a diode 150. The output of the comparator 146 is also connected to +11V through a resistor 152 and to the inverting input of the comparator 146 via a resistor 154. A capacitor 156 is connected between the inverting input and system ground. The output of the comparator 144 is connected to +11V by a pull up resistor 158 and to the base of the transistor 122.

The second alternate means 96 operates to provide substantially continuous power to the electronic circuitry at a current rate of approximately 250 milliamps by pulse width modulating the storage capacitor 40 voltage and charge the capacitor 130 to +12V. The transistor 116 is controllably biased "off" and "on" in response to the transistor 122 being respectively biased "on" and "off" by the comparator 144. The comparator 144 controls the duration for which the transistor 116 is biased "on" as a function of the voltage of the capacitor 130. The magnitude of the analog voltage delivered to the noninverting input is responsive to the voltage level of the capacitor 130 and the triangular voltage waveform delivered by the asynchronous oscillator to the inverting input of the comparator 144 generates a pulse output when the analog voltage is greater than the oscillator voltage. The second alternate means 96 effectively blocks the first means 94 from powering the electronic circuitry by reverse biasing diode 104.

Figure 2A:
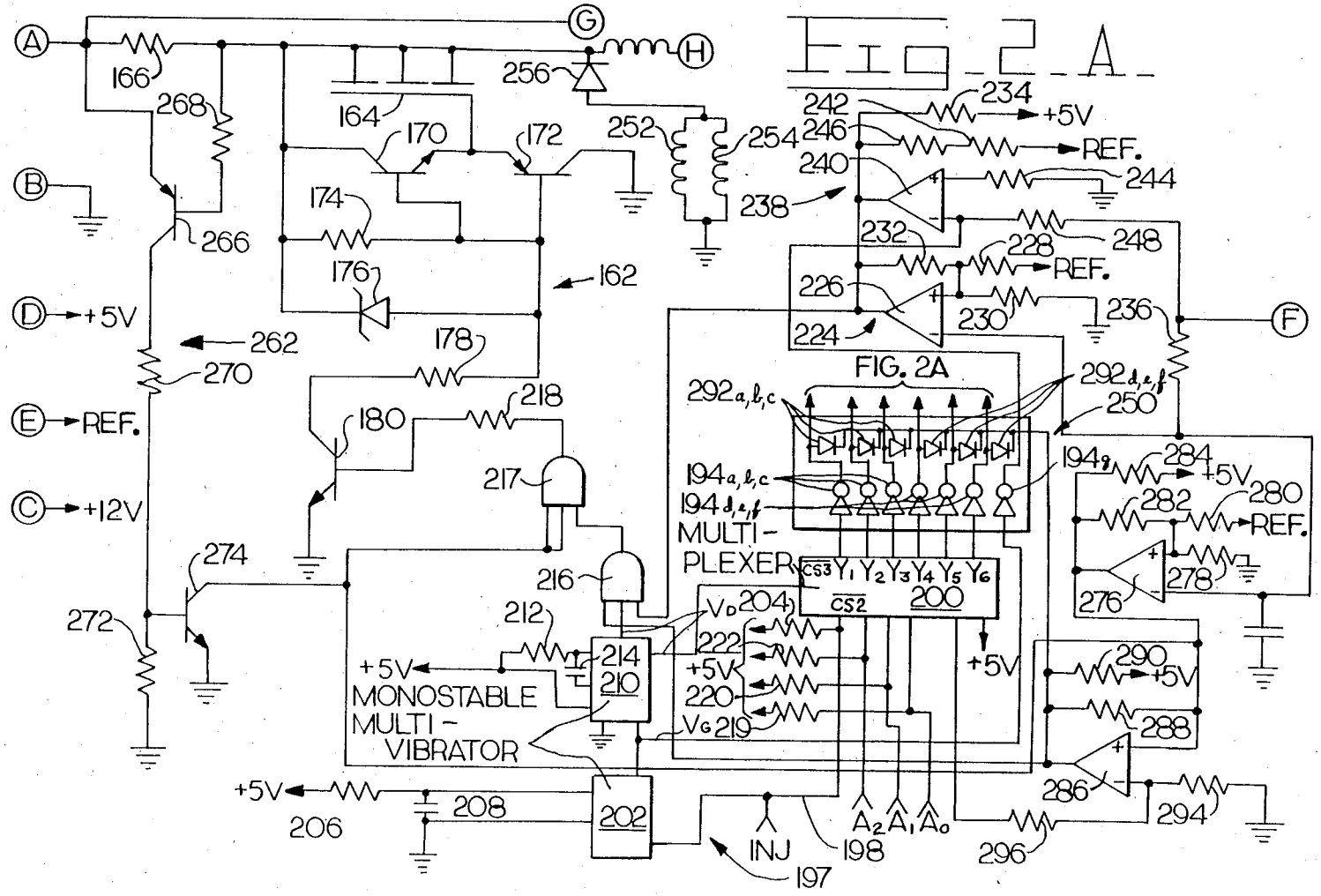
FIG. 2 illustrates an electrical schematic of an embodiment of a solenoid driver circuit.
Figure 2B:
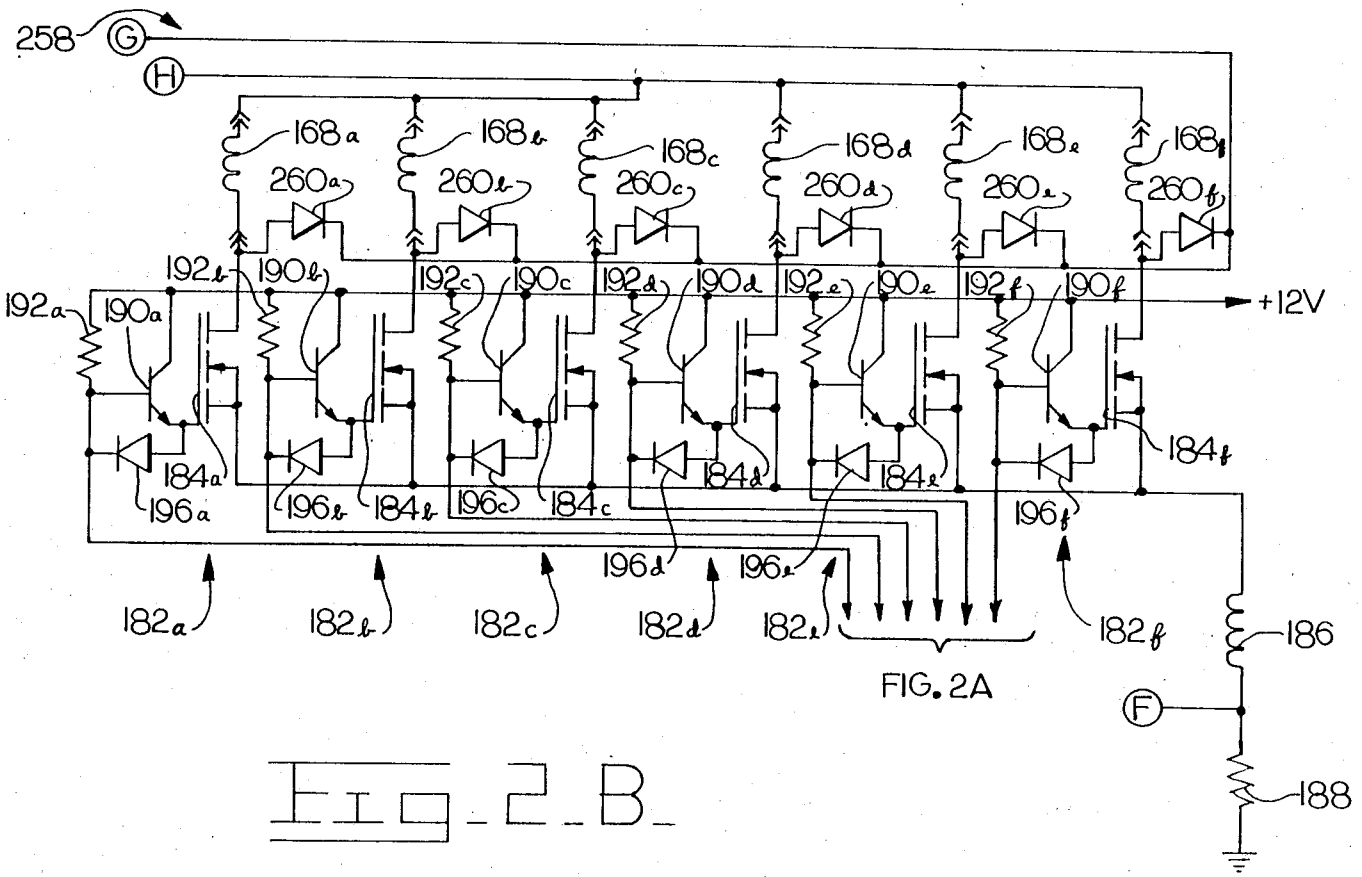

FIGS. 2A and 2B collectively illustrate a solenoid driver circuit 160 which has a first switching means 162 that controllably connects and disconnects a solenoid coil 168 to and from a storage capacitor 40 in response to receipt of a control signal. The first switching means 162 includes a field effect power transistor 164 which has a source connected through a current sensing resistor 166 to the storage capacitor 40 and a drain connected to the coil 168 of the fuel injection solenoid. The gate of the transistor 164 is connected to the emitters of a pair of npn and pnp type transistors 170, 172. The collector of the npn transistor 170 is connected to the source of the transistor 164 and to the bases of both the npn and the pnp transistors 170, 172 through a parallel connection of a resistor 174 and zener diode 176. The collector of the pnp transistor 172 is connected to system ground. Both of the bases of the transistors 170, 172 are also connected to system ground through a resistor 178 and a transistor 180.

A second switching means 182 controllably connects and disconnects the coil 168 of the fuel injection solenoid to and from system ground in response to receipt of a control signal. The second switching means 182 includes a field effect transistor 184 which has a drain connected to the coil 168 and a source connected to system ground through an inductor 186 and current detecting resistor 188. A transistor 190 connects the gate of transistor 184 to +12V through the collector and emitter path. The base of the transistor 190 is connected to +12V through a resistor 192 and to the output of a buffer gate 194. A diode 196 is connected between the emitter of the transistor 190 and the output of the buffer 194 to provide a current path to system ground when the transistor 190 is biased "on". The second switching means 182 has been described as though only a single solenoid is being controlled; however, an examination of FIGS. 2*a* and 2*b* reveals that a plurality of coils 168*a*–168*f* and switching means 182*a*–182*f* are illustrated, as for example, in a multicylinder engine. Operation of all of the second switching means 182*a*–182*f* are similar and can easily be described by detailing the operation of a single second switching means 182. The components of the second switching means 182*a*–182*f* are identical and will hereafter be referred to by common element numerals with a letter suffix corresponding to the second switching means 182*a*–182*f*. The method of addressing the individual switching means 182*a*–182*f* will be described in greater detail later in this specification.

A means 197 controls the duration of the fuel injection pulses for each of the solenoids by delivering a first control signal to the first and second switching means 162, 182 to enable the first and second switching means 162, 182 and initiate current flow in the solenoid coil 168. The means 196 includes an externally generated injection pulse which has a time duration dependent upon the desired quantity of fuel to be delivered to the individual cylinders of the multicylinder engine. Generation of the injection pulse is not considered to be part of the instant invention and is therefor not described or shown herein other than to indicate that it is delivered on a line 198 to an enabling input of a multiplexer 200 and a multivibrator 202. The line 198 is connected to +5V through a pull up resistor 204 and is consequently normally "high" except in the presence of a "low" injection pulse. The multivibrator 202 has a resistor 206 and a capacitor 208 connected between +5V and system ground, the values of which determine the duration of a pulse delivered over an output line to an input of a multivibrator 210 and to the input of a buffer gate 194*g*. The multivibrator 210 also has a resistor 212 and a capacitor 214, the values of which determine the duration of an output pulse delivered to an enabling input of the multiplexer 200. An inverted output signal is also delivered from the multivibrator 210 to the input of an AND gate 216. An output of the AND gate 216 is connected to the input of another AND gate 217 which has an output connected to the base of the transistor 180 via a resistor 218. The state of the transistor 180 ultimately controls the bias of the transistor 164.

The multiplexer 200 has three address lines connected to +5V through pull up resistors 219, 220, 222 and are normally "high" except in the presence of a "low" signal from an external addressing device. The addressing device is not considered to be a portion of the present invention and will not be described herein other than to recognize that the address lines form a three bit binary word, the numeric value of which accesses one of eight output ports Y0–Y7 of the multiplexer 200. Output ports Y1–Y6 are respectively connected to input buffers 194*a*–194*f* which control the states of the second switching means 182*a*–182*f*.

A third means 224 senses the magnitude of the current in the solenoid coil 168 and delivers a second control signal to the first switching means 162 to alternately connect and disconnect the solenoid coil 168 to and from the storage capacitor 40 when the magnitude of the current respectively falls below and rises above a first and second preselected level. The third means includes a comparator 226 which has a noninverting input connected to reference voltage through a resistor 228, system ground through a resistor 230, and to the output of the comparator 226 through a resistor 232. The output of the comparator is connected to an input of the AND gate 216 and to +5V via a pull up resistor 234 while an inverting input is connected to the current sensing resistor 188 via a resistor 236.

A fourth means 238 senses the magnitude of the current in the solenoid coil and delivers a third control signal to the first switching means 162 to alternately connect and disconnect the solenoid to and from the storage capacitor 40 when the magnitude of the current respectively falls below and rises above a third and fourth preselected level. The third and fourth preselected levels are less than both the first and second preselected levels. The fourth means 238 includes a comparator 240 which has a noninverting input connected to reference voltage through a resistor 242, system ground through a resistor 244, and to the output of the comparator 240 via a resistor 246. The outputs of the comparators 240, 226 are connected as are the inverting inputs via a resistor 248 and the resistor 236. The noninverting input of the comparator 240 is also connected to the output of the buffer gate 194*g*. This connection provides a fifth means 250 which prevents delivery of the third control signal for a second preselected duration of time when the first control signal is received. For example, the "low" injection pulse triggers the multivibrator 202 which delivers a "high" pulse for a preselected duration of time to the buffer gate 194*g*. The output of the buffer gate 194 is connected to system ground as is the inverting input of the comparator 240. The current flowing through the current sensing resistor 188 has no effect on the voltage level of the noninverting input of the comparator 240. Thus, the comparator 240 is prevented from delivering a control signal responsive to the current in the solenoid coil 168 while the multivibrator 202 is triggered.

Operation of the solenoid driver circuit 160 is as follows. An injection pulse triggers the multivibrator 202 and enables the multiplexer 200 to read the address lines and output a "low" signal on the corresponding output port Y0–Y7. For example, assume that the signals on the address lines correspond to the binary number 001, the output port Y1 is biased "low" which causes the buffer gate 194*a* to disconnect the second switching means 182*a* from system ground. The transistor pair 184*a*, 190*a* is biased on by +12V which electrically connects the solenoid coil 168*a* to system ground through current sensing resistor 188. Correspondingly, the comparator 226 is free to operate and monitor the current which flows through the current sensing resistor 188 increasing at an exponential rate. Thus, the comparator 226 is biased "on" by the reference voltage on the noninverting input. A "high" signal from the comparator 226 is passed by the AND gates 216, 217 and biases the transistor 180 "on". With the transistor 180 biased "on", a "low" voltage is developed at the bases of the transistors 170, 172. Transistor 170 is biased "off" and transistor "172" is biased "on" which connects the gate of transistor 164 to a voltage equivalent to the storage capacitor voltage less the zener diode voltage drop. Consequently, the transistor 164 is biased "on" and the storage capacitor 40 is connected to the solenoid coil 168. Current begins to flow through the solenoid coil 168 increasing exponentially until the voltage presented to the inverting input of the comparator 226 by the current sensing resistor 188 rises above the reference voltage on the noninverting input of the comparator 226. The output of the comparator 226 is connected to system ground and a "low" signal is delivered to and passed by the AND gates 216,217 which biases the transistor 180 "off" and the transistor 170 "on". A "high" signal on the gate of transistor 164 biases that transistor "off" and disconnects the charged solenoid coil 168 from the storage capacitor 40.

A seventh means 251 provides an alternate current path to discharge the solenoid coil 168 when only the first switching means 162 controllably disconnects the solenoid coil 168 from the storage capacitor 40. A current flyback path must be provided to prevent a damaging inductive spike from occurring when the coil 168 is disconnected from the storage capacitor 40. A resistor 252 and an inductor 254 are connected in parallel to one another and in series with a diode 256 between system ground and the drain of the transistor 164. When the second switching means 182 is biased "on" and the first switching means 162 is biased "off", a current flyback path exists from the solenoid coil 168 through the transistor 184, the current sensing resistor 188, the inductor 254 and resistor 252, the diode 256, and back to the solenoid coil 168. Energy is dissipated slowly to maintain the solenoid coil 168 at this pull in current level for a substantial period of time without the need to bias the transistor 164 "on" and recharge the solenoid coil 168. The reference voltage present at the noninverting input of the comparator 226 is somewhat reduced by the lack of a feedback voltage from output of the comparator 226. The current level must decay to a second preselected level lower than the first to bias the comparator 226 "on" again and recharge the solenoid coil 168. The current level will continue to oscillate between the first and second preselected levels for the entire duration of the output pulse from the multivibrator 202.

Figure 4:
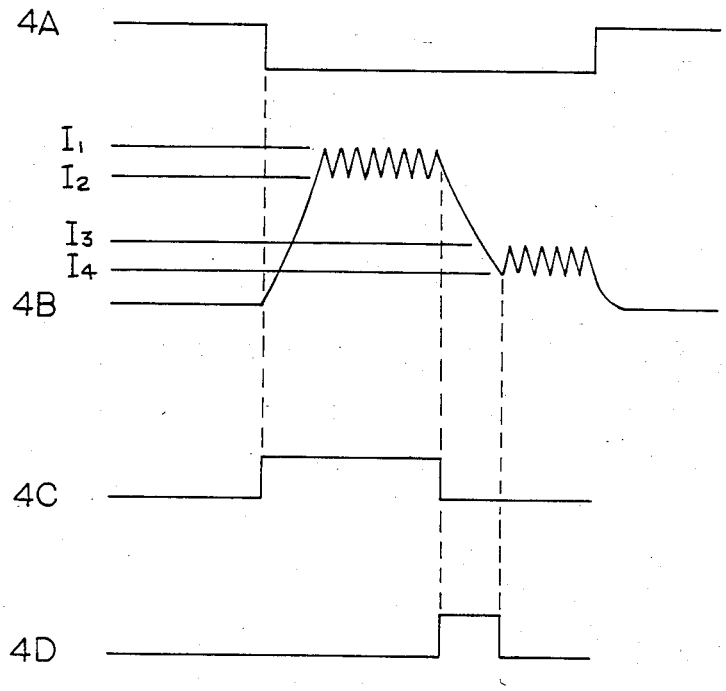
FIG. 4 illustrates a graphical representation of a group of electrical waveforms associated with the electrical schematic of the solenoid driver circuit.

The waveforms illustrated in FIG. 4 are helpful in understanding the operation of the solenoid current driver 160. FIG. 4*a* shows a graphical representation of the injection pulse. FIG. 4*b* shows the current flowing through the solenoid coil 168 versus time. The first and second preselected current levels are illustrated as I1 and I2. The output pulse of the multivibrator 202 is shown in FIG. 4*c* as occurring substantially simultaneous with the injection pulse and the beginning of the exponential increase in current flowing through the solenoid coil 168.

A sixth means 257 prevents delivery of the first control signal for a third preselected duration of time after termination of the second preselected duration of time. The "high" to "low" transition at the end of the multivibrator 202 pulse indicates termination of the second duration of time and triggers the multivibrator 210 which delivers a "high" pulse to the multiplexer 200 and a "low" pulse to the AND gate 216 (as shown in FIG. 4*d*). The multiplexer 200 is disabled by the "high" signal and delivers a "high" signal on the output port Y1 for the entire duration of the multivibrator 210 pulse. The second switching means 182 is subsequently biased "off" which isolates the solenoid coil 168 from system ground and prevents current from flowing through either the current sensing resistor 188 or the flyback diode 256. The multivibrator also delivers a "low" signal to the AND gate 216 which biases transistor 164 "off" for the entire duration of the multivibrator 210 pulse. Thus, the first control signal is prevented from being delivered to both the first and second switching means 162, 182.

An alternate means 258 is provided to discharge the solenoid coil 168 to the storage capacitor 40 when the coil 168 is disconnected from both the storage capacitor 40 and system ground. The means 258 includes a diode 260 connected between the drain of the transistor 184 and the storage capacitor 40. Each of the solenoid coils 168*a*–168*f* similarly have a corresponding means 258*a*–258*f* which includes respective diodes 260*a*–260*f*. Isolation of the coil 168 creates an inductive spike which biases the diode 260 "on" and creates a current flyback path between the coil 168 and the storage capacitor 40.

The duration of the multivibrator 210 pulse is selected to allow the solenoid coil 168 current to decay to approximately a level that is slightly higher than the hold in current of the solenoid coil 168. At the end of the multivibrator 210 pulse the multiplexer 200 is enabled and delivers a "low" signal to the buffer gate 194*a* which biases the second switching means 182 "on" and allows current to flow through the current sensing resistor 188 and coil 168. The input to the AND gate 216 from the multivibrator 210 returns to a "high" state and enables the AND gate 216 to pass the signal from the third and fourth means 224,238 to the transistor 180 returning bias control of the first switching means 162 to the third and fourth means 224, 238. The voltage applied to the inverting input of the comparator 240 is now responsive to the current flowing in the current sensing resistor 188. Thus, when the current decays below the third preselected level set by the reference voltage applied to the noninverting input of the comparator 240 in the absence of the feedback voltage, then the comparator 240 is biased "on" and delivers a "high" signal to the AND gate 216. The AND gate 216 passes the signal to bias the first switching means "on" which begins charging the inductor toward the fourth preselected magnitude.

Operation of either one of the comparators 226, 240 to the "off" condition will result in a "low" signal being delivered to the AND gate 216 irrespective of the condition of the other of the comparators 226, 240. Moreover, either comparator 226, 240 can bias the first switching means 162 "off"; however, both comparators 226, 240 are required to bias the first switching means 162 "on". For example, at the hold-in current level the comparator 226 will always be biased "on" because the voltage level of the current sensing resistor 188 will be substantially less than the second preselected magnitude. The comparator 240 will act to maintain the voltage level of the current sensing resistor between the third and fourth preselected levels by biasing the first switching means 162 "off" and "on".

At the end of the injection pulse the multiplexer 200 is disabled by the "high" signal on line 198 which biases the second switching means 182 "off" and disconnects the coil 168 from system ground. The energy stored in the coil 168 is dissipated through the alternate means 258 and returned to the storage capacitor 40 to be reused during the next injection pulse.

Two separate overcurrent protection means 262, 264 are included in the solenoid driver circuit 160. The first overcurrent protection means 262 includes a pnp type transistor 266 which has an emitter connected to the storage capacitor 40, a base connected to the source of transistor 164 through a resistor 268, and a collector connected to system ground through a pair of series connected resistors 270, 272. An npn type transistor 274 has a base connected to the intersection of the series resistors 270, 272, an emitter connected to system ground, and a collector connected to an input of the AND gate 217. If the current flowing through the current limiting resistor 166 becomes sufficiently great, then the transistor 266 will be biased "on" and conduct current through the resistor pair 270, 272. The voltage drop across the resistor 272 biases the transistor 274 "on" and connects the AND gate 217 input to system ground. The AND gate 217 passes the "low" signal to transistor 180 which ultimately biases the transistor 164 "off".

The second overcurrent protection means 164 includes a comparator 276 which has an inverting input connected to the current sensing resistor 188 through the resistor 236. The noninverting input of the comparator 276 is connected to system ground through resistor 278, +5V through resistor 280, and to the output of the comparator 276 via resistor 282. The output of the comparator 276 is also connected to +5V via pull-up resistor 284 and to a noninverting input of a comparator 286. A feedback resistor 288 interconnects the output and the noninverting input of the comparator 286. The output of the comparator 286 is connected to +5V via pull up resistor 290, to an input of the AND gate 216, and to the outputs of buffer gates 194*a*–194*f* via respective diodes 292*a*–292*f*. The noninverting input of the comparator 286 is connected to system ground through a resistor 294 and to the YO output of the multiplexer 200 via a resistor 296. The second overcurrent protection means 264 operates to disable both the first and second switching means 162, 182 in the event that the current flowing in the current sensing resistor 188 exceeds a preselected acceptable level. For example, if the voltage drop across the current sensing resistor 188 is greater than the reference voltage applied to the noninverting input of the comparator 276, then the comparator 276 is biased "off" and its output is connected to system ground. The "low" signal is delivered to the comparator 286 which is biased "off" and delivers a low signal to the AND gate 216. The low signal at AND gate 216 subsequently biases the first switching means 162 "off". Similarly, the low output of comparator 286 biases the diodes 292*a*–292*f* "on" which biases the second switching means 182 "off". The output of comparator 286 will remain latched "low" to prevent further actuations of the solenoid 168 until address 000 is delivered with an injection pulse. The same operation occurs in response to to the first overcurrent protection means 262 being actuated. Latching of the comparator 286 output to a "low" value is initiated via a connection between the collector of the transistor 274 and the noninverting input of the comparator 286.

INDUSTRIAL APPLICABILITY

In the overall operation of the apparatus 10, assume that injection pulse signals and addressing signals are being supplied to the solenoid driver circuit 160 by an external control device responsive to a variety of engine operating parameters (e.g., engine speed, exhaust gas oxygen content, atmospheric pressure, etc.). The step up voltage supply will, at start up, charge the storage capacitor 40 to, for example, 90V by repetitively charging the inductor 18 and controllably discharging an inductive voltage spike to the storage capacitor 40.

The first and second switching means 162, 182 operate under external control to connect a selected solenoid coil 168*a*–168*f* to the storage capacitor 40 and establish a first pull-in current level in the selected coil 168*a*–168*f* for a preselected duration of time. The pull-in current urges the solenoid to a closed position and allows fuel to be injected into a selected cylinder. In the closed configuration a significantly greater volume of the armature is disposed within the coil 168 such that a lesser magnitude of current is required to maintain the solenoid in the closed configuration. Resultingly, the current level in the coil 168 is reduced to a hold-in level for the remainder of the injection pulse. The energy savings which arises from this method of solenoid energization are readily apparent; however, a second beneficial result comes from the speed with which the solenoid may be opened. The time required to open the solenoid is directly related to the amount of energy which must be dissipated. Therefore, with the current level being substantially reduced, the magnitude of the energy which must be dissipated is also reduced and the speed of operation of the solenoid must necessarily be increased.

Significant additional energy savings results from operation of the alternate means 258 during the transistion of the current level from the pull-in to the hold-in levels and from the hold-in level to zero current level. The alternate means 258 returns the energy dissipated during these two transistions to the storage capacitor 40. The storage capacitor 40 has been partially discharged by the charge initially delivered to the coil 168 and the step up voltage supply 12 is cycling the inductor 18 to recharge the capacitor 40. The energy returned from the coil 168 is simultaneously delivered with the inductor 18 voltage to the storage capacitor 40 which increases the capacitor charge toward a preselected voltage level. The means 56 controls the cycling of the inductor 18 to ensure that the voltage level of the capacitor 40 is maintained within prescribed limitations. Consistent control of the capacitor 40 voltage level is important to ensure that the rise time of the current level in the coil 168 is consistent (see FIG. 4*b*). The rise time controls the lag between the beginning of the injection pulse and the opening of the fuel injection solenoid; consequently, rise time has an effect on the duration of time for which the solenoid is open and hence upon the quantity of fuel delivered.

Similarly, variations in decay time also have an effect on the quantity of fuel delivered. Thus, the operation of the means 258 provides a fast decay time which minimizes variations in fuel quantity due to unit to unit variations. At the end of the injection pulse, both the first and second switching means 162,182 are biased "off" and the means 258 discharges the solenoid coil 168 to the storage capacitor 40 in preparation of the next injection pulse for another of the coils 168*a*–168*f*. At this point the entire process is repeated with a new multiple bit address delivered over the addressing lines to access another coil 168*a*–168*f*.

Other aspects, objects, and advantages can be obtained from a study of the drawings, the disclosure, and the appended claims.

I claim:

1. A fuel injection solenoid driver circuit, comprising:

a solenoid coil;

a storage capacitor;

first switching means for controllably connecting and disconnecting a solenoid coil to and from a storage capacitor in response to receiving a control signal;

second switching means for controllably connecting and disconnecting said solenoid coil to and from system ground in response to receiving a control signal;

means for delivering a first control signal to said first and second switching means and enabling said first and second switching means for a first preselected duration of time to initiate current flow in said solenoid coil;

third means for sensing the magnitude of the current in said solenoid coil and delivering a second control signal to said first switching means to alternately connect and disconnect said solenoid coil to and from the storage capacitor in response to the magnitude of said current respectively falling below and rising above a first and second preselected level;

fourth means for sensing the magnitude of the current in said solenoid coil and delivering a third control signal to said first switching means to alternately connect and disconnect said solenoid coil to and from the storage capacitor in response to the magnitude of said current respectively falling below and rising above a third and fourth preselected level, said third and fourth preselected levels being less than both of said first and second preselected levels;

fifth means for preventing delivery of said third control signal for a second preselected duration of time in response to receiving said first control signal;

sixth means for preventing delivery of said first control signal for a third preselected duration of time after termination of said second preselected duration of time; and means for discharging said solenoid coil to said storage capacitor in response to disconnecting said solenoid coil from both said storage capacitor and system ground.

2. The fuel injection solenoid driver circuit, as set forth in claim 1, including a seventh means for providing an alternate current path for discharging said solenoid coil in response to only said first switching means controllably disconnecting said solenoid coil from said storage capacitor.

3. The fuel injection solenoid driver circuit, as set forth in claim 1, wherein said first switching means includes:

a field effect transistor having a source, gate, and drain, the source of said transistor being connected to said storage capacitor and the drain of said transistor being connected to said solenoid coil;

first and second bipolar junction transistors each having an emitter, collector, and base and respectively being of the npn and pnp type, the emitters of said first and second transistors being connected to the gate of said field effect transistor, the collectors of said first and second transistors being respectively connected to said storage capacitor and ground, and the bases of said first and second transistors being connected to said storage capacitor through a parallel connection of a first resistor and a zener diode; and a third bipolar junction transistor of the npn type having an emitter, base, and collector, the emitter of said third transistor being connected to system ground, the collector of said third transistor being connected through a second resistor to the bases of said first and second transistors, and said third transistor being adapted for controllably connecting and disconnecting said solenoid coil to and from said storage capacitor in response to receiving a control signal on the base of said transistor.

4. The fuel injection solenoid driver circuit, as set forth in claim 1, wherein said second switching means includes:

a field effect transistor having a source, gate, and drain, the drain of said transistor being connected to said solenoid coil and the source of said transistor being connected to system ground;

a bipolar junction transistor having an emitter, collector, and base and being of the npn type, the emitter of said bipolar junction transistor being connected to the gate of said field effect transistor, the collector of said bipolar junction transistor being connected to a voltage source;

a resistor connected intermediate the base of said bipolar junction transistor and said voltage source;

a diode connected intermediate the emitter and base of the transistor; and said transistor being adapted for controllably connecting and disconnecting said solenoid coil to and from system ground in response to receiving a control signal on said base.

5. The fuel injection solenoid driver circuit, as set forth in claim 1, wherein said storage capacitor is charged to a first preselected voltage by a step up power supply, said supply including:

an inductor having a first terminal connected to a source of power, said source of power having a voltage substantially less than said first preselected voltage;

a switching means for providing a low impedance path from a second terminal of said inductor to system ground, said switching means disconnecting said inductor from ground in response to receiving a control signal;

a means for monitoring the magnitude of the current flowing through said inductor and said switching means and delivering a control signal to said switching means for a preselected duration of time in response to the magnitude of said current being greater than a preselected level;

a power diode having a cathode connected to said inductor and an anode connected to said storage capacitor; and a means for monitoring the magnitude of the voltage of said storage capacitor and delivering a control signal to said switching means in response to said storage capacitor voltage being greater than a preselected magnitude.

6. The fuel injection solenoid driver circuit, as set forth in claim 5, including first and second alternate means for supplying regulated voltage to said fuel injection driver circuit, said first alternate means being connected to said source of power, and said second alternate means being connected to said storage capacitor.

* * * * *

UNITED STATES PATENT AND TRADEMARK OFFICE

CERTIFICATE OF CORRECTION

PATENT NO. : 4,604,675

DATED : August 5, 1986

INVENTOR(S) : Mark R. Pflederer

It is certified that error appears in the above-identified patent and that said Letters Patent is hereby corrected as shown below:

Column 6, line 23, "12V" should be --+12V--;

Column 11, line 54, "164" should be --264--; and

Column 12, line 22, the word "to" should be deleted (second occurrence)

Column 13, line 39, "a" both occurrances should be --the--.

Signed and Sealed this

Thirtieth Day of August, 1988

*Attest:*

DONALD J. QUIGG

*Attesting Officer*

*Commissioner of Patents and Trademarks*